United States Patent [19]

Sauerwein et al.

[11] Patent Number: 4,982,501

[45] Date of Patent: Jan. 8, 1991

[54] DEPTH OF CUT ADJUSTMENT FOR A PORTABLE CIRCULAR SAW

[75] Inventors: William D. Sauerwein, Phoenix; John W. Miller, Parkton; Stephen L. Vick, Reisterstown; Rosemarie Bean, Finksburg, all of Md.

[73] Assignee: Black & Decker Inc., Newark, Del.

[21] Appl. No.: 488,823

[22] Filed: Mar. 5, 1990

[51] Int. Cl.[5] ..... B27B 9/02

[52] U.S. Cl. ..... 30/376; 30/377

[58] Field of Search ..... 30/374–377, 30/388–391

[56] References Cited

U.S. PATENT DOCUMENTS

| | | | |
|---|---|---|---|
| 2,761,474 | 9/1956 | Dolan . | |
| 3,242,953 | 3/1966 | McCarty et al. | 30/375 |
| 3,262,471 | 7/1966 | McCarty | 30/377 |
| 3,292,673 | 12/1966 | Gregory . | |
| 4,221,051 | 9/1980 | Glass | 30/377 |
| 4,353,165 | 10/1982 | Albery | 30/377 X |
| 4,856,394 | 8/1984 | Clowers | 30/376 X |

FOREIGN PATENT DOCUMENTS

| | | |
|---|---|---|
| 1991206 | 5/1968 | Fed. Rep. of Germany . |
| 243236 | 12/1985 | German Democratic Rep. . |
| 701418 | 12/1953 | United Kingdom . |
| 1024688 | 3/1966 | United Kingdom . |

*Primary Examiner*—Douglas D. Watts

*Attorney, Agent, or Firm*—Dennis A. Dearing; Charles E. Yocum; John D. Del Ponti

[57] ABSTRACT

In a portable circular saw depth of cut adjustment is effected by pivoting movement between a shoe 24 (which supports the saw on a workpiece) and a motor and gear case housing 26 (carrying the saw blade 12) about a pivot connection 28 rearward of the motor and gear case housing. Forward of the housing 26 an upwardly extending arcuate depth slide 38, fixed to the shoe 24, slidably engages an arcuate depth guide 40 carried by the motor and gear case housing 26. Towards the upper end of the depth slide 38, and in generally fixed relation to it, a clamping assembly 42 selectively clamps the depth slide 38 and depth guide 40 together to establish a depth of cut adjustment setting. The essentially fixed relationship of the locking knob 100 of the clamping assembly 42 to the shoe 24 mean that the operations of changing depth adjustment setting may be made without changing operator's hand positions on the saw. In addition, the fixed position of the knob 100 in sawing operations mean that by design, suitably shaped, sized and positioned, it may be used as an auxiliary handle in guiding the saw in operations.

15 Claims, 4 Drawing Sheets

DEPTH OF CUT ADJUSTMENT FOR A PORTABLE CIRCULAR SAW

BACKGROUND OF THE INVENTION

The invention concerns arrangements for adjusting the depth of cut of portable circular saws and, more particularly, arrangements for saws in which depth of cut is adjusted by pivoting movement between a shoe, which supports the saw on a workpiece, and a subassembly of the saw including the saw blade and motor, and in which depth of cut is established by the extent to which the blade emerges from the shoe.

In portable circular saws depth of cut is set by controlling the extent to which a blade portion emerges from the under or gauging surface of a shoe which supports the saw on the workpiece. This implies relative movement between the shoe and a subassembly of the saw which may include a motor and transmission with an output shaft drivably carrying the blade. The two principal known forms of articulation of this relative movement are pivotal and so-called vertical. In the first the blade and motor subassembly are pivotably connected to the shoe for pivoting about an axis parallel to the axis of rotation of the saw blade. In the second, the adjusting motion of the blade and motor subassembly relative to the shoe is a straight line perpendicular to the shoe working surface.

An advantage of the vertically adjusted saw is that a constant angular relationship between the saw handle and the shoe and work is maintained at all depths of cut. See for example U.S. Pat. No. 3,292,673 Gregory. This advantage is partially offset however in shallow cutting depth settings by the distance of the handle from the cutting edge of the blade, making operator control more difficult and leaving the hand in a poor position to push the saw. And typically, a single cantilevered support is used to support the blade and motor subassembly above the shoe with a lockable straight slide or track connection between them. In use the center of gravity of the blade and motor subassembly is usually offset from the support slide, tending to put the slide in a bind so that adjustment of depth of cut requires careful application of a counterbalancing force by the operator to effect adjusting movement. A further disadvantage of the vertical adjustment configuration is the potential instability of the saw at very shallow depths of cut because of the relative elevation of the center of gravity of the unit above the work piece, caused by the bodily separation of the entire blade and motor subassembly from the shoe.

In West German utility model patent GBM No. 1991206, Lutz has disclosed a variation on the vertical adjustment configuration which uses a pair of spaced apart vertical supports, each with a rack and pinion, and with a common pinion shaft for effecting movement. This arrangement should avoid the binding problem and facilitate precise adjustment of depth of cut, but the system is inevitably expensive and the problems of instability and control at shallow cuts remain.

In the "pivot" type of adjustment configuration the pivotable connection between blade and motor subassembly and shoe may be ahead of the motor (front pivot) or rearwardly of the motor (rear pivot). Typically the blade and motor subassembly is "braced" from the shoe on the opposite side of the motor from the pivot by an adjustable slide arrangement. Typically the shoe, the blade and motor subassembly, and the slide arrangement connecting the blade and motor subassembly to the shoe define, respectively, the three sides of a triangle—a structure which is inherently more stable and efficient than the cantilevered arrangement of the so-called vertically adjusted saw.

A desirable depth of cut adjustment system provides for convenient, easy and speedy manipulation to set the desired depth of cut. In some applications an operator may need to change depth of cut very frequently so that an apparently minor adverse characteristic of the adjustment procedure may, in the long run, make a significant difference in operating efficiency and cost. Two significant aspects of depth of cut adjustment arrangements are first, the consistency of ease of effecting relative movement between portions of the adjusting mechanism, and second, the kind and frequency of hand movements required during an adjustment procedure. In adjusting depth of cut, typically an operator holds the saw steady with one hand grasping the main operator handle while, with his other hand, he manipulates the adjustment mechanism. In the vertical adjustment system referred to above a locking knob for an adjustable slide arrangement may be carried in fixed relation to the shoe so that, potentially, the operations of releasing the slide and moving the shoe relative to the blade may be done with one (the same) hand without removing that hand from the locking knob. But in practice, due to the overhanging weight of the motor and blade subassembly and especially at shallow cuts when slide engagement is limited, the adjusting slide may bind and the second hand must be moved to the shoe, for example, grasping it so as to counteract the binding and permit sliding movement between the shoe and the blade and motor subassembly.

In the pivoted adjustment systems, support of the blade and motor subassembly is shared between the pivot connection of the subassembly to the shoe and the mating or cooperating adjustment slide components so that the potential binding problems inherent in the cantilevered vertical adjustment system are avoided. However, in the known pivoted adjustment systems, both the slide locking control (locking knob) and the main operator's handle are fixed to the blade and motor subassembly so that after unlocking the adjustment slide the operator's hand must be moved to grasp the shoe so as to swing it on its pivot relative to the motor and blade subassembly, and then moved back again for locking the adjustment slide. An example of this depth of cut adjustment arrangement, in a rear pivot configuration, is disclosed in British patent GB No. 1,024,688 which shares a common assignee with the present invention.

A second form of pivoting depth of cut adjustment is disclosed in East German Patent No. DD243,236 Forster. Here the main operator's handle is effectively part of a subassembly including the shoe. The motor and blade subassembly pivoted to the shoe includes a slide (slot) selectively engaged by a clamping arrangement (locking knob) also carried by the shoe subassembly. In adjusting Forster therefore the operator is also required to remove his hand from the clamping device—in this case to the blade and motor subassembly—in order to pivot that assembly relative to the shoe.

A common characteristic of the two pivoted adjustment systems just described is that the main operator's handle and the clamping or locking control of the adjustment mechanism are carried on the same subassembly, thus requiring an extra hand movement in making an adjustment of depth of cut.

SUMMARY OF THE INVENTION

Accordingly, it is an object of the invention to provide a depth of cut adjustment arrangement for a portable circular saw that is structurally efficient and which reliably provides a convenient depth of cut adjustment procedure requiring a minimum of hand movements by the operator.

It is also an object to devise a depth of cut adjustment system in which a locking or clamping control for the system is disposed appropriately, in a fixed relationship to the shoe of the saw, so that it may function as an auxiliary handle for use by the operator in controlling the saw.

It is a further object to combine with a depth of cut adjustment arrangement having an adjustment element such as a depth slide attached to the shoe, a camming element integral with the adjustment element for engaging a rotationally positionable upper guard of the saw and coordinating positioning of that guard with the depth of cut adjustment setting.

These objects may be realized, in one form, in a portable circular saw in which a first adjustment element, such as an adjustment guide structure, extends upwardly from the shoe of the saw and which element carries, in an upper portion, in fixed relation to the shoe, a hand operated locking or clamping element and in which a motor and blade subassembly of the saw carries a second adjustment element, such as a guide structure, and in which the motor and blade subassembly is pivotably connected to the shoe so that the first and second adjustment elements or guide structures may slidably engage one another and may be selectively locked together by the hand operated locking element to establish a desired depth of cut. In a preferred embodiment, the pivotable connection of the motor and blade subassembly to the shoe is positioned rearwardly of the motor and blade subassembly and the hand operated locking element is positioned forwardly of the motor and blade subassembly so that the hand operated locking element (fixed in relation to the shoe) may be optimally positioned and shaped so as to serve as an auxiliary handle for control of the saw in sawing operations.

It is an advantage of a depth of cut arrangement according to the invention, in which the hand operated locking element is associated with the shoe while the main operator's handle is associated with the motor and blade subassembly, that depth of cut adjustment can be made without changing the operator's basic hand positions on the saw, potentially increasing productivity and reducing fatigue, especially in operations which include frequent changes of depth of cut. In addition, a depth indicator scale may be included in the rotatable upper guard which, because of the relative hand positions, is easily observed when adjusting depth of cut.

In a preferred embodiment the respective adjustment elements carried by the shoe and the motor and blade subassembly are mating arcuate structures centered on the pivotable connection between the shoe and the motor and blade assembly so that frictional forces between the guide elements or guide structures are minimized, thus reducing operator effort in making an adjustment. Further, when the hand operated locking element also serves as an auxiliary handle, neither the adjustment procedure itself, nor the transition from sawing operation to adjustment operation requires any change of operator hand positions on the saw.

Compared with so-called vertical adjustment saws a pivotable adjustment saw according to the invention provides a natural swinging movement between saw subassemblies for adjustment. Throughout the adjustment range the configuration of the invention applies no binding torque to the slide and the operator has only to supply a simple smooth translatory movement, and does not have to exert a compound effort to overcome or avoid imposing a bind in an adjustment slide mechanism. Depth of control adjustment systems according to the invention therefore advantageously combine a first adjustment control (locking knob) in fixed position relative to the shoe and a second adjustment control (main operator handle) on the blade and motor subassembly, so that no shifting of operator hands is required during an adjustment, with a stable pivoted configuration that permits relative movement without binding. An additional advantage, in a rear pivot configuration, is that the first adjustment control (locking knob), being fixed in relation to the shoe, is potentially positioned to function effectively as an auxiliary control handle during sawing operation. The cost and potential hindrance of providing a separate auxiliary handle are avoided.

In combination, the control and operational advantages of the invention enhance those inherent in the rear pivot saw configuration, especially those deriving from the juxtaposition of the main operator handle and the pivot. Throughout the range of adjustment the center of the handle remains in about the same place, relatively low on the saw, well placed to assist the operator in pushing and guiding the saw through the work. In adjusting for shallower depths of cut the handle merely tilts backwards, making the saw potentially even easier to push and control.

In a preferred embodiment a camming element of an adjustment guide structure carried by the shoe engages a rotatably carried upper guard of the saw and coordinates rotatable position of the guard with the selected depth of control adjustment setting.

DESCRIPTION OF THE PREFERRED EMBODIMENT

Figure 1:
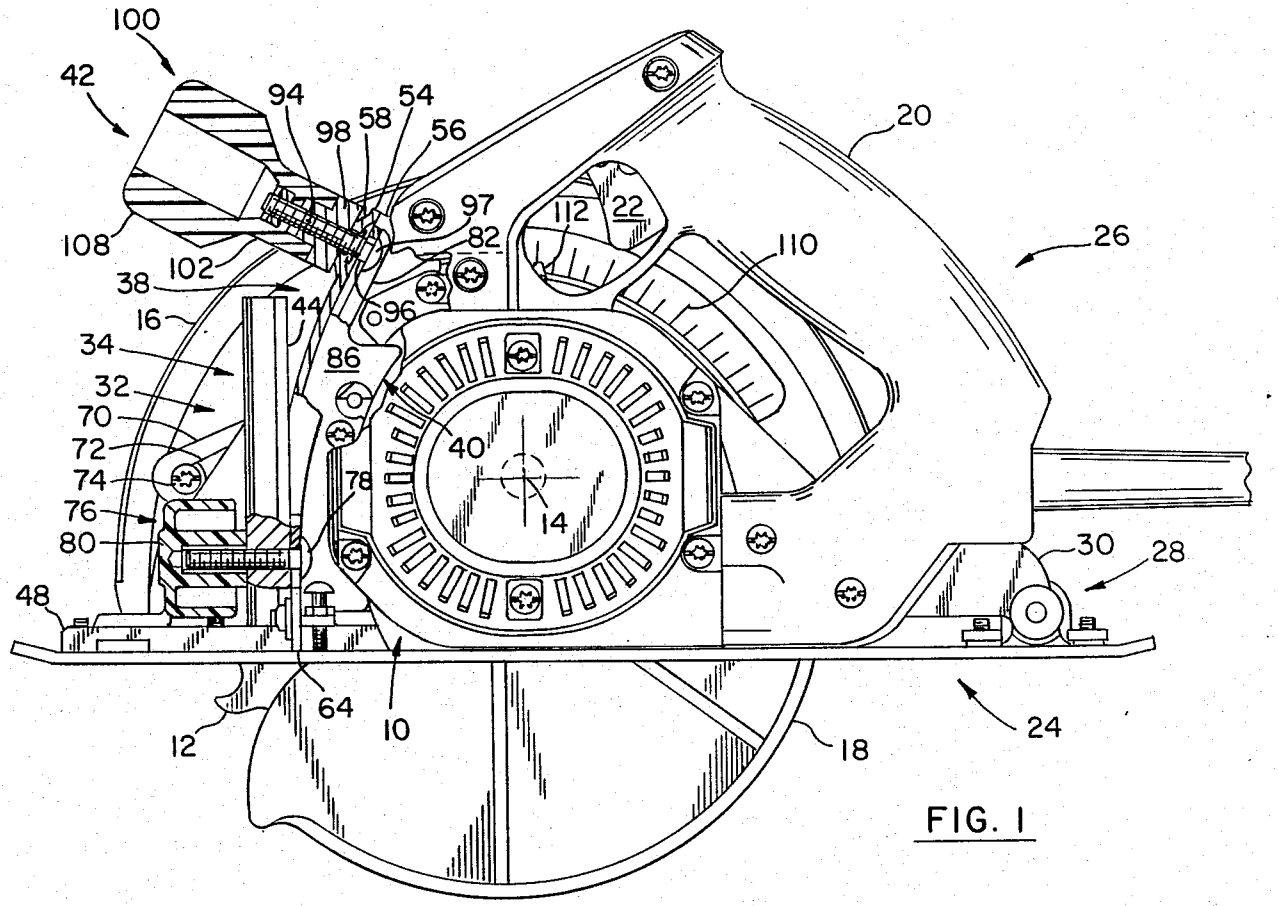
FIG. 1 is a left side elevation of a portable circular saw embodying the invention shown adjusted for maximum depth of cut and partially sectioned to show some details of the depth of cut and bevel angle of cut adjustment mechanisms.

The invention is embodied in the portable electrically powered circular saw shown in the drawings. The saw is in some respects conventional and so will not be described in complete detail.

Principal components of the saw are motor and gear case housing 10 which carries a conventional blade 12 rotating about axis 14 and shielded in operation by upper and lower guards 16 and 18 respectively. As is conventional, the upper guard 16 is mounted to be freely rotatable on the housing 10 but is restrained in a manner to be described below. Also as is conventional, the lower guard 18 is pivotably and retractably connected to the upper guard 16. The main pistol-grip operator handle 20 is associated with a trigger switch 22 for controlling the flow of electrical power to the saw motor. In operation, the saw as a whole is supported on a workpiece by a shoe 24.

To provide for depth of cut and bevel angle of cut adjustment the shoe 24 is adjustably connected to the rest of the saw. Motor and gear case housing 10, blade 12, the handle 20 and the guards 16, 18 form an integral subassembly 26 which, for convenience in description, will be referred to as housing 26. The housing 26 is connected to the shoe 24 at a rear pivot assembly 28, to which it is connected by a radius arm 30 extending from the motor and gear case housing 10 and, towards the front of the shoe, by a combined depth of cut and bevel angle adjustment mechanism 32.

A principal component of the adjustment mechanism 32 is an upright quadrant bracket 34 mounted rigidly on the shoe 24. Connected directly to this member is a first depth adjustment member, depth slide 38. Final connection to the motor and gear case housing 10 is by a second depth adjustment member, elongated guide 40 rigidly attached to the motor and gear case housing 10. For depth of cut adjustment the housing 26 is pivotable about the rear pivot assembly 28 on a pivot axis parallel to the blade axis of rotation 14 with the depth slide 38 and guide 40 in slidable engagement and lockable at a selected adjustment position by means of locking or clamp assembly 42. Adjustment operation will be described in more detail below.

The quadrant bracket 34 consists essentially of an upright transverse wall portion 44 including an arcuate slot 46, and anchored rigidly to the shoe 24 through a base member 48 by a suitable means such as riveting. The arcuate periphery 50 of wall 44 is suitably marked, (markings 52), to assist in setting bevel cutting angle.

Depth slide 38 bears against the rear of the wall 44 of the quadrant bracket 34. It consists of a central "spine", channel-shaped member 54 with opposite side flanges 56 and, towards its upper end, an embossed hole 58. The channel 54 is arcuate in form and in assembly its arc is concentric with the transverse axis of the pivot assembly 28 and substantially tangential to the motor and gear case housing 10. Ears extend from both sides of the base of the channel 54. A pivot ear 60, with the aid of a suitable means such as pivot pin 62, pivotably connects the depth slide 38 to a laterally extending pivot lug 63 of the quadrant bracket 34 for pivoting in a transverse plane. On the opposite side of the channel a bevel quadrant ear 64 bears against the rear of the quadrant bracket wall 44 and includes a short arcuate slot 66, registering with the slot 46 in the quadrant bracket 34.

A third ear, cam ear 68 generally above the pivot ear 60 extends laterally and is then bent forward to define a cam wall 70 including a slightly curved cam slot 72. The cam slot 72 is engaged by a fixed laterally extending boss 74 extending from the inside wall of the upper guard 16.

Bevel locking assembly 76 releasably clamps depth slide 38 to quadrant bracket 34 to selectively fix the bevel angle of the shoe 24 relative to the housing 26. Bevel locking assembly 76 includes a headed, threaded bolt 78 passing through the respective slots 72, 46 to be secured by a threaded locking knob 80.

The depth guide 40 is fixedly mounted on the forward side of the motor and gear case housing 10. Its form is basically that of an arcuate channel 82 with opposite side flanges 84, which include mounting ears 86, 88 for facilitating its integration into the motor and gear case housing 10 and handle 20 with which it is longitudinally aligned. The circumferential wall or face 90 of the channel 82 includes a central elongated guide slot 92.

In assembly the channel 82 of depth guide 40 is also concentric with the transverse pivot axis of the pivot assembly 28 and slidably and concentrically engages the channel 54 of the depth slide 38. Any selected juxtaposition of depth slide 38 and depth guide 40 is fixed by means of the locking or clamping assembly 42. This includes, in the present embodiment, a carriage bolt 94 with a short square neck 96 non rotatably engaging the slot 92 of depth guide 40. The bolt 94 passes radially outwards through the slot 92 and the embossed hole 58 of depth slide 38 and through a shouldered boss 98 which is rigidly fixed to the depth slide 38, as by swaging or welding, in register with the hole 58. Locking knob 100 includes an inner collar portion 102 which fits rotatably over the shouldered boss 98 and includes a recess 104 for non-rotatably holding a threaded nut 106, threadedly engaging the bolt 94. An enlarged handle portion 108 of the locking knob 100 is sized and shaped for comfortable manipulation of the clamping assembly 42 to establish depth of cut and also to serve as an auxiliary operating handle for grasping by the saw operator in sawing operations.

In operation, bevel cutting angle is established in a conventional manner by manipulation of the bevel locking assembly 76 and depth slide 38 becomes rigidly fixed to the shoe 24, and provides a fixed support for the locking or clamping assembly 42 and, notably, the locking knob 100.

To change depth of cut the locking knob 100 is rotated to loosen the bolt 84, relieving a clamping force between the depth slide 38 (carried by the shoe) and the depth guide 40 (carried by the housing 26) so that adjustment may be made with relative pivoting between shoe 24 and housing 26 at pivot assembly 28. Although relative movement between the depth slide 38 and the depth guide 40 is generally guided by the generous overlap of their arcuate channels 54 and 82 respectively, actual clamping force tends to be localised adjacent the locking assembly 42. Depth slide 38 may therefore be said to have a localised clamping or locking face 54*a* (see FIG. 2) towards the upper end of channel 54 while the registering clamping or locking face of depth guide 40 may be anywhere along the outer surface of its channel 82. The combined bore of the embossed hole 58 of the depth slide 38 and the fixed bushing or boss 98 is of sufficient length to prevent cocking of the bolt 94, so that any binding or catching, particularly of bolt head 97, is reliably avoided. This radially extending stability of the locking assembly 42 is particularly important given that the knob 100 is used not only to effect clamping or loosening but also, by being pushed circumferentially, to propel the shoe towards or away from the housing 26.

Having established a desired depth of cut adjustment setting the locking knob 100 is rotated to draw up the bolt 94 so as to firmly clamp depth slide 38 and depth guide 40 together. Depth of cut adjustment may be accomplished conveniently quickly and comfortably by an operator who is preferably grasping the saw's main operating handle 20 with one hand, and the depth of cut adjustment locking knob 100 with the other. Because the locking knob 100 is fixedly carried the operations or actions of releasing the clamping assembly 42, varying the spacing between the handle 20 and the locking knob 100 to establish a new depth of cut adjustment, and again securing the clamping assembly 42 may all be done without the operator removing his other hand from the locking knob 100.

The concept of the invention includes not only improving the depth of cut adjustment system but also, in combination, and while meeting that objective, selecting a disposition for and form of locking knob (100) so that the locking knob may function efficiently and comfortably as an auxiliary handle for control of the saw, to be used in conjunction with the main handle 20.

Figure 2:
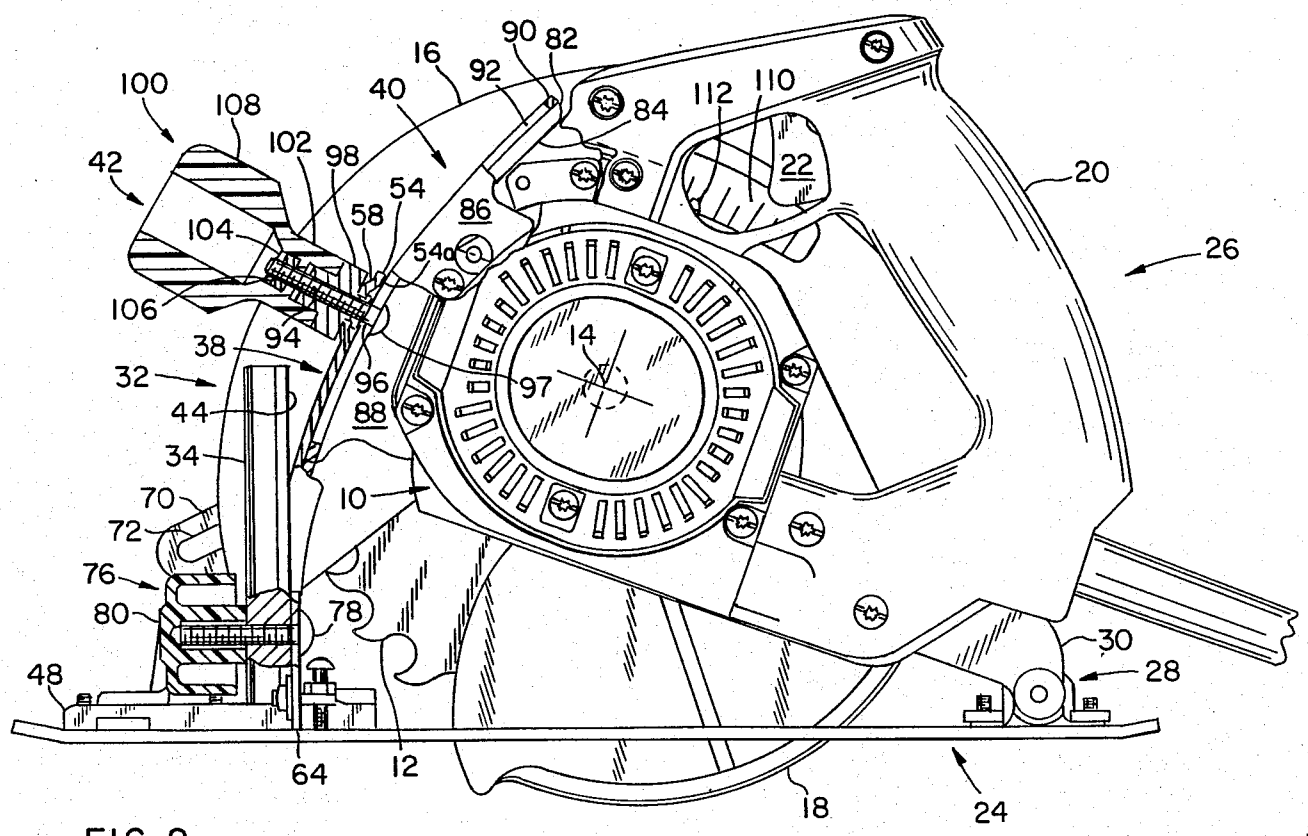
FIG. 2 is a view similar to FIG. 1 but with the saw adjusted for minimum depth of cut.
Figure 3:
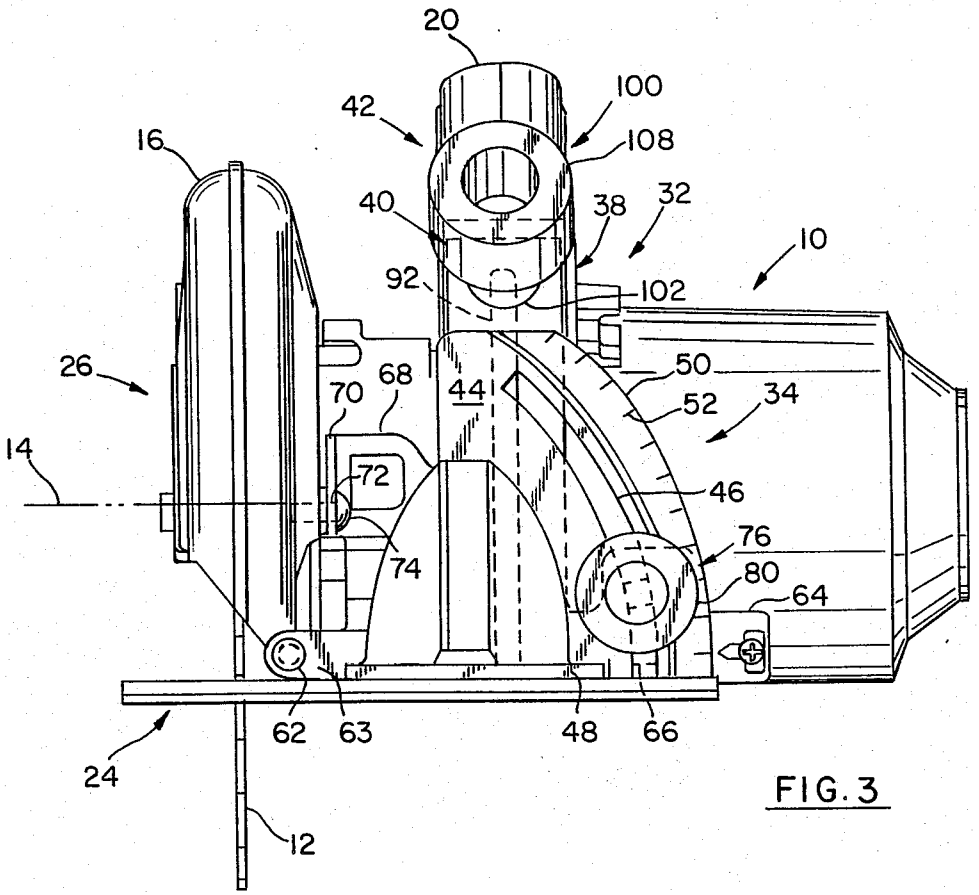
FIG. 3 is a front elevation of the saw as shown in FIG. 1.
Figure 4:
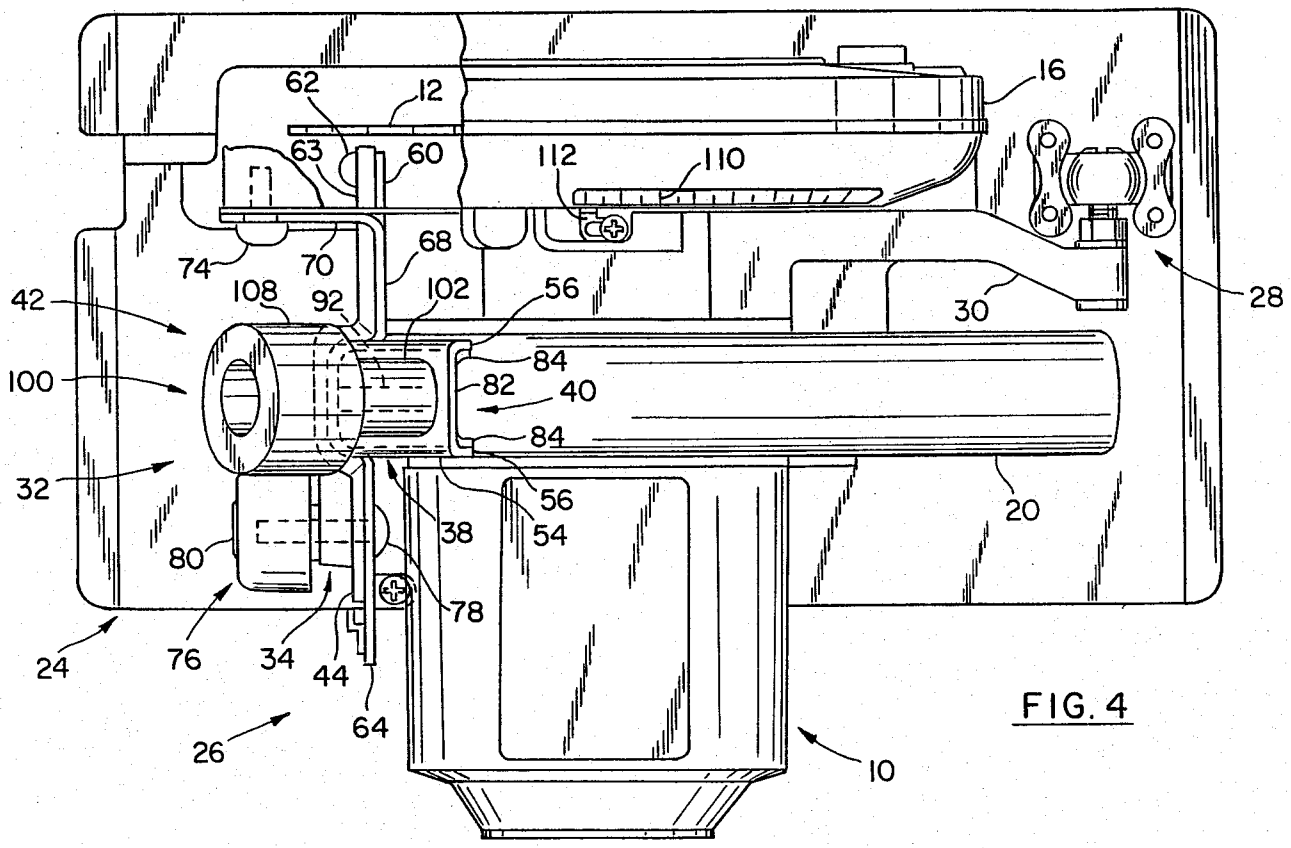
FIG. 4 is an overhead view of the saw as shown in FIG. 1.

Maximum and minimum depth of cut settings for the saw are shown respectively in FIGS. 1 and 2. Throughout the range of adjustment an appropriate rotatable positioning of the upper guard 16 relative to the motor and gear case housing 10 and more particularly with respect to coverage of the saw blade 12 adjacent a forward portion of the shoe 24, is maintained through the camming action of the boss 74 on the upper guard 16, engaging and following the cam slot 72 in the depth slide 38. (Seen best in FIGS. 1 and 2). Thus this auxiliary, safety function is provided without specific moving parts such as a separate linkage and hence with a potential for cost reduction and improved reliability. And operating efficiency is enhanced by the convenient and highly visible depth of cut setting indication provided by the scale markings 110 on the upper guard 16 (see FIGS. 1, 2 and 3) juxtaposed with the fixed pointer 112 carried by the motor and gear case housing 10. The rotatable positioning of the upper guard 16 relative to the housing 10, as depth of cut setting is changed, gives a direct indication of depth of cut setting.

What is claimed is:

1. In a portable power driven saw of the type having a generally fore and aft extending shoe for supporting the saw on a workpiece, and a blade and motor subassembly disposed so that the blade extends in a fore and aft plane and below the shoe so as to establish a depth of cut, a depth of cut adjustment arrangement comprising:

pivot means for connecting the blade and motor subassembly to the shoe towards a first end of the shoe and on a first side of the blade and motor subassembly for facilitating relative pivoting movement between the blade and motor subassembly and the shoe, about a transverse axis, for adjustment of the depth of cut;

a first generally upwardly extending depth adjustment member carried by the shoe and disposed, in assembly, on a second side of the blade and motor subassembly opposite from the first side;

a second depth adjustment member carried by the blade and motor subassembly and disposed to slidably engage the first depth adjustment member during pivoting movement for depth of cut adjustment; and means carried in fixed relation by the first depth adjustment member for adjustably securing the respective first and second depth adjustment members together to establish a selected depth of cut.

2. The depth of cut adjustment arrangement of claim 1 wherein both depth adjustment members include arcuate surfaces and wherein the slidable engagement of the first member with the second comprises mutual engagement of their respective arcuate surfaces.

3. The depth of cut adjustment arrangement of claim 2 wherein the second depth adjustment member includes a slot and wherein the means for adjustably securing the depth adjustment members together includes a generally radially extending clamping element extending through the slot.

4. A portable electrically powered circular saw comprising:

an elongated generally planar shoe with first and second opposite ends and a longitudinal axis;

an upwardly extending first adjustment member carried by the shoe towards its first end and including a first locking face facing towards the second end and spaced upwardly from the shoe;

a powered saw blade subassembly including an operator handle and a saw blade carried for rotation on an axis perpendicular to the longitudinal axis of the shoe, the saw blade subassembly being pivotably connected to the shoe towards the shoe's second end for permitting swinging movement of the subassembly relative to the shoe about an axis perpendicular to the longitudinal axis of the shoe;

a second locking face carried by the saw blade subassembly and facing away from the pivot axis for slidably engaging the first locking face; and releasable locking means carried by the upwardly extending adjustment member towards its upper end for holding the respective locking faces together at a selected juxtaposition so as to establish a depth of cut.

5. The circular saw of claim 4 wherein the second locking face is arcuate in form and defines an arc centered on the pivot axis.

6. The circular saw of claim 5 wherein the saw blade subassembly includes a motor housing and the second locking face is substantially tangential to the motor housing.

7. The circular saw of claim 5 wherein the first locking face is arcuate in form and registers with the arcuate form of the second locking face.

8. The circular saw of claim 4 wherein the releasable locking means includes a locking knob rotatively manipulable for operating the locking means.

9. The circular saw of claim 4 wherein the locking means includes a threaded fastener extending generally radially with respect to the pivot axis.

10. The circular saw of claim 9 wherein the second locking face is included in a second adjustment member carried by the saw blade subassembly and said second member includes a slot extending circumferentially with respect to the pivot axis and engageable by the threaded fastener of the locking means.

11. The circular saw of claim 4 wherein, in normal sawing operation, the second end is the rear end of the shoe.

12. The circular saw of claim 4 and further including an upper guard at least partially shielding the blade, carried by the saw blade subassembly and mounted to be concentrically shiftable with respect to the blade and wherein the first adjustment member includes a fore and aft extending cam element and the upper guard includes a cam follower engaging the cam element so that when the saw blade subassembly is pivoted relative to the shoe the upper guard is shifted rotationally relative to the blade.

13. The circular saw of claim 4 wherein the pivotable connection of the saw blade subassembly to the shoe permits relative tilting of the shoe about a fore and aft extending axis and wherein the first adjustment member is pivotably connected to the shoe so that the saw blade subassembly may be tilted relative to the shoe to provide for cutting on the bevel.

14. A portable circular saw of the type in which a powered saw blade subassembly having first and second opposite ends is pivotably connected at its first end to a shoe and in which the second end is adjustably spaceable from the shoe by an adjustment means including cooperating slidably engaging arcuate members characterized in that:

the powered saw blade subassembly includes a fixed main operator's handle and in that the adjustment means includes a locking knob manipulable to lock the saw blade subassembly at a selected spacing from the shoe and the locking knob is carried in fixed relation to the shoe so that adjustment of the spacing between the saw blade subassembly and the shoe may be effected by an operator holding the saw in one hand by the operator's handle and grasping the locking knob with the other hand without relinquishing his grasp of the locking knob.

15. The circular saw of claim 14 wherein, in relation to a forward direction of out, the locking knob is disposed forwardly of the main operator's handle and disposed and shaped so that said locking knob may serve as an auxiliary handle for control of the saw during sawing operations.

* * * * *